US010570615B2

(12) United States Patent
Richmond et al.

(10) Patent No.: US 10,570,615 B2
(45) Date of Patent: Feb. 25, 2020

(54) INSULTING MEMBER FOR A HOLE IN AN ATTIC FLOOR

(71) Applicant: Yankee Insulation Products, LLC, New Boston, NH (US)

(72) Inventors: Matthew James Richmond, North Canton, OH (US); Mark James Richmond, New Boston, NH (US)

(73) Assignee: Yankee Insulation Products, LLC, New Boston, NH (US)

( * ) Notice: Subject to any disclaimer, the term of this patent is extended or adjusted under 35 U.S.C. 154(b) by 0 days.

(21) Appl. No.: 15/968,124

(22) Filed: May 1, 2018

(65) Prior Publication Data

US 2018/0320375 A1 Nov. 8, 2018

Related U.S. Application Data

(60) Provisional application No. 62/500,247, filed on May 2, 2017.

(51) Int. Cl.
*E04B 9/00* (2006.01)
*E04B 1/80* (2006.01)
*E04F 11/06* (2006.01)

(52) U.S. Cl.
CPC ..... *E04B 9/003* (2013.01); *E04B 1/80* (2013.01); *E04F 11/06* (2013.01); *E04F 11/062* (2013.01)

(58) Field of Classification Search
CPC .. E04B 1/80; E04B 9/003; E04F 11/06; E04F 11/062
See application file for complete search history.

(56) References Cited

U.S. PATENT DOCUMENTS 4,344,505 A * 8/1982 Waters ..... E04F 11/064 182/47
5,271,198 A * 12/1993 Freeman ..... E04F 11/062 182/46
5,475,955 A * 12/1995 Dickinson ..... E04F 11/064 182/46
5,623,795 A * 4/1997 Padgett, Jr. ..... E04F 11/06 182/47
5,628,151 A * 5/1997 Monat ..... E04F 11/062 182/46
6,625,933 B1 * 9/2003 Moeller ..... E06B 7/16 49/489.1
7,650,722 B1 1/2010 Melesky
7,690,165 B2 * 4/2010 Taylor ..... E06B 9/04 182/46
7,836,638 B2 * 11/2010 Ogieglo ..... E06B 5/01 52/19

(Continued)

*Primary Examiner* — Adriana Figueroa
(74) *Attorney, Agent, or Firm* — Sand, Sebolt & Wernow Co., LPA

(57) ABSTRACT

A multimode or multi-configuration insulation assembly includes a cover and a frame. The frame has a seal or gasket which may be oriented upwardly in a first configuration or oriented downwardly in a second configuration. In the first configuration, the insulation assembly defines an insulative 5-sided box. In the second configuration, the insulation assembly is a four-sided frame with a removable cover, which enables the four-sided frame to remain installed on the attic floor to act as a dam to hold back blown-in attic insulation when the cover is removed to permit ingress and egress to the attic through the opening formed in the attic floor.

18 Claims, 6 Drawing Sheets

(56) References Cited

U.S. PATENT DOCUMENTS

| | | | | |
|---|---|---|---|---|
| 7,849,644 | B2 * | 12/2010 | Melesky | E04B 9/003 49/463 |
| 8,590,229 | B2 * | 11/2013 | Taylor | E04F 11/062 182/46 |
| 8,661,750 | B2 * | 3/2014 | Melesky | E04B 1/7608 52/199 |
| 8,943,767 | B2 * | 2/2015 | Lewis | E04D 13/0335 52/20 |
| 9,222,265 | B2 | 12/2015 | Richmond et al. | |
| 9,695,630 | B1 * | 7/2017 | Arthur | E04B 1/76 |
| 9,869,123 | B2 * | 1/2018 | Arthur | E06B 3/7001 |
| 2002/0112409 | A1 * | 8/2002 | Knowles | E04F 11/064 52/19 |
| 2009/0133342 | A1 * | 5/2009 | Copeland | E04B 9/003 52/202 |
| 2011/0138713 | A1 * | 6/2011 | Reed | E06B 5/01 52/204.1 |
| 2014/0137498 | A1 * | 5/2014 | Melesky | E04B 1/7608 52/404.4 |
| 2016/0032641 | A1 * | 2/2016 | Melesky | E04B 1/7608 52/407.2 |

* cited by examiner

INSULTING MEMBER FOR A HOLE IN AN ATTIC FLOOR

CROSS REFERENCE TO RELATED APPLICATIONS

The present disclosure claims the benefit of and priority to U.S. Provisional Patent Application Ser. No. 62/500,247, filed on May 2, 2017, the entirety of which is incorporated herein by reference.

BACKGROUND

Technical Field

The present disclosure relates generally to insulation. More particularly, an insulation device is provided to cover an access opening in an attic floor. Specifically, a multimode insulation device is provided in such a way as to be a variably deployable insulation device.

Background Information

The access opening in an attic floor (in particular, an opening that incorporates a foldable ladder or what is commonly referred to as a "pull-down attic stairs") is a weak spot in a home's insulation and thermal barrier. While surrounding attic floor space may be insulated to at least minimum U.S. Department of Energy or locally recommended guidelines, leaving the area over an attic access point uninsulated can reduce the overall R-Value of the attic insulation system. This weak spot in the insulation is often also a weak spot in the air barrier of a home, allowing air to pass between the conditioned (living) area and unconditioned (attic) areas of the home. Through what is known as the "stack effect," this air movement can result in the loss of heated air in the colder weather (forcing a home's heating system to run more often to maintain a comfortable temperature) and an unwanted gain of heated air in warm weather (when heated attic air forces its way into the living area of a home, causing a home's cooling system to work harder to maintain a comfortable temperature).

There are several solutions currently in use to insulate over pull-down attic stair access openings. The simplest method is to drape batts of insulation over the opening as the stairs are being folded up. This is awkward and messy, and mostly ineffective because a consistent depth of insulation cannot be guaranteed. Any insulation placed in this manner will be pushed up by the closing pull-down attic stairs and will likely fall into the living space of the home the next time the pull-down attic stairs are pulled down from the ceiling. Besides offering minimal insulation value, this method offers no air sealing value.

Another solution is a site-built or in situ (specific for each application) cover. This option can be very expensive due to the cost of appropriate materials and the labor required to do a quality job.

Several commercial kit solutions are available for this in situ application, but most offer a choice of either insulation or air seal, not both. Some products, such as the Therma-Dome® Pull-Down Attic Stair Cover (first introduced in 1991), have been designed to offer both insulation and air sealing in one device.

Common practice in the industry is to either site-build from scratch or use a commercial kit to cover an attic stair opening. The products that are available commercially are each specific to a certain type of application. Most of these products are intended to be used only in attics that have solid floors.

Another attempt at providing an attic insulation assembly is disclosed in U.S. Pat. No. 7,650,722 (the '722 patent). The '722 patent discloses a cover for pull-down attic stairs that are structured to seal a ceiling access opening. The '722 patent provides a closure member constructed of insulating material that is cooperatively and frictionally received within an open frame formed of the same material to form an airtight seal therebetween. However, while the '722 patent may arguably be effective at forming an airtight seal, it provides a kit that is used only in a single configuration. It is not a multimode or multi-configuration assembly. Further, if the device of the '722 patent was modified to be installed in multiple modes, it would likely be considered inoperable for its intended purpose because it would not create an airtight connection. In particular, the sidewalls of the '722 patent remain in place and need to be sealed to the floor.

Various methods can be used to achieve an air seal. Using some form of industry-proven weather seal gasket is the preferred method. Certain techniques, such as friction-fit components, offer additional challenges during installation, requiring precise placement of those components to achieve an effective seal. Over time and with repeated use, friction engaged components can also be subject to wear that will diminish the effectiveness of the seal.

SUMMARY

Issues continue to exist with insulation assemblies configured to cover an access opening in an attic floor. Particularly, the objective of each respective cover determines its ultimate shape. Thus, a need continues to exist for an attic insulation assembly that can be configured in multiple configurations or modes so as to enable the user to decide how they choose to implement the attic insulation assembly. The user only needs to purchase a single kit. The present disclosure addresses these and other issues.

One non-limiting exemplary distinctive feature of this pull-down attic stair cover or assembly of the present disclosure is the convenience it will allow for an installer to have one kit that will effectively air seal and insulate an attic stair opening in multiple configurations.

Due to the large size of the assembled cover, the cover will come as a kit to be assembled on-site (i.e., in situ assembly). When properly assembled and installed, the cover will achieve the desired R-value (insulating level) and provide an effective air seal at the same time. The kit will consist of components that will assemble to form, in one embodiment, a five-sided box (four panels to form long and short vertically-oriented sides and one panel to form a horizontally-oriented top), into which the folded attic stairs will fit when the stairs are in their "stored" (or "closed") position. It is possible that the cover could be shipped in a pre-assembled and ready-for-installation state.

Each of the side panels will have some form of seal or gasket on one edge. The top panel may be permanently affixed to the four side panels (with the gasket oriented opposite the top panel) to form a five-sided box that is removable in its entirety for unobstructed access to an attic that has a solid floor. This defines a first mode or first configuration.

Alternatively, the four side panels may be attached directly to the floor plane (or the floor itself) with the gasket side toward the top, allowing the sidewalls to act as "insulation dams" that will hold loose-fill insulation in place (allowing a full depth of insulation on the attic floor plane right up to the access opening). The top panel, in this configuration, would be removable for access to the attic space. This defines a second mode or second configuration.

Further variations of the "insulation dam" installation may include having one or more of the vertical panels (for example, the end closest to the hinge of the pull-down attic stairs) removable for easier access to the attic, while the rest of the side panels may remain fixed to the attic floor to hold the insulation in place. If one of the vertical panels is removable, then an appropriate seal or gasket would be used to create a hermetic connection. Alternatively, the dam may be formed from a frame of three connected sidewalls defining a U-shaped configuration and a cover having an L-shaped configuration such that when the cover is connected to the frame, a five-sided box is formed.

The lid and side components may be constructed of rigid material, preferably a material with a significant R-value (such as, but not limited to, polyisocyanurate board). Any of these components may be constructed as one solid panel, or a panel may be constructed with layered material to yield the desired finished thickness and R-value.

In constructing the cover, components may be lap-jointed, butt-jointed, ship-lapped, finger-jointed, or otherwise joined together. Multiple joint types may be utilized concurrently. An air-tight and sealed connection of the joints may be accomplished by a combination of adhesive and foil tape, but other chemical and mechanical mechanisms could be utilized to effectuate the hermetic seal between adjacent components of the cover. Some exemplary and non-limiting mechanisms include mechanical fasteners, spikes, caulk, and gaskets, or a combination thereof.

The panels may come in one piece or, for ease of packaging and shipping, may be made of modular components that shall be assembled together as part of the installation process.

To facilitate multiple installation configurations, all possible required components for assembly and installation will be included in the kit. There will be some components of the assembly that may not be used in a particular installation. For example, if the cover is assembled as a five-sided box (the five panels are conjoined) that lifts off of the attic floor in its entirety, the lid attachment mechanisms (installed on the top panel) may not be used.

Similarly, if the cover is installed with the sidewalls affixed to the floor plane or the floor itself (to act as an insulation dam or baffle, for example), the anchor points that are included to accommodate an attachment of the five-sided lift-off cover to the floor plane may not be used.

Some features of the cover will be used in any configuration. The attachment mechanism (for example, but not limited to, a Velcro® hook-and-loop strap) will be used in conjunction with the anchor mechanism (i.e., nail-in anchor point) to attach the five-sided cover over the access opening. Alternatively, the attachment mechanism will work in conjunction with the attachment mechanisms affixed to the lid to hold the lid to the stationary sidewalls.

The gasket that is attached to one of the long edges of each side panel will also serve a functional purpose in either configuration. If used in the first mode as a five-sided lift-off cover, the gasket will seat against the attic floor plane, effecting an air seal where the movable cover meets the immovable floor. If installed in the second mode in the lift-off lid configuration, the gasket will be in a stationary position at the top of the sidewalls where the movable lid will seat against it, producing an effective air seal between the movable lid component and the stationary sidewall components.

As another example, the medium included with the kit (for example, but not limited to, liquid adhesive or tape) to bond together the components in the five-sided cover configuration could also be used to bond the sidewalls to the floor plane of the attic in the lift-off lid configuration.

It is understood that a high insulation value will not be required in every situation, so a version of the cover could include two or more "layers" in the construction of the cover. The first "layer" will serve as a base, providing an air seal and offering an initial R-value (for example, R-20) that will make a noticeable difference in most applications as a standalone cover.

For work that requires higher R-value (for example, to comply with DOE specs, IECC, or other work specification standards potentially requiring R-38 or more), additional "layers" will be available to the installer. For convenience in installation, additional layers will be pre-cut to exactly or closely fit the base layer that has been already assembled. The second layer may encompass all or only a portion of the base cover. For example, the second layer may only be required on the horizontal top panel (lid or cover), on the vertical side panels (sides), or on both. The second layer may (or may not) include additional gasket to further ensure an effective air seal. Various joining techniques (butt-joints, lap-joints, finger joints, etc.) may be used in the construction of any additional "layers." The additional layer will fit over the base layer in either configuration (five-sided or lift-off lid configuration), and may be attached to the existing base by adhesive, caulk, tape, fasteners, nails, spikes, staples, brads, or other non-chemical and non-mechanical connecting mechanisms. Furthermore, while tape is utilized to join and seal sidewalls to end walls, other mechanical, chemical, or non-mechanical and non-chemical fastening mechanisms could be utilized.

Besides having additional "layers," alternate methods could be used to achieve desired insulation value results based on factors such as material availability and budget. Such alternative method examples could include the use of a product such as the Therma-Dome® Maximize-R Supplemental Insulation System (allowing fiberglass batt to be installed in a consistent and neatly contained fashion) or the surface application of two-part spray foam to a desired depth.

To add convenience to product installation into an attic with an unfinished floor, "strips" of rigid or semi-rigid floor material (by way of non-limiting example, plywood, oriented strand board, or insulation board) may be included with the kit to install around the attic access opening to save the installer time when measuring and cutting floor material to fit, and it would provide an effective base for the cover to be installed upon in either configuration. To prevent thermal by-pass (that is, air transfer through weaknesses in the air barrier between conditioned and unconditioned spaces of a home), the cavities between the attic joists would need to be filled. In one example, this is accomplished by constructing a small floor plane that extends out from the attic access opening.

In the first configuration, the cover will be assembled as a five-sided box that rests over the attic stair opening. The gasketed edge will be on the bottom of the sidewalls and the non-gasketed edge will be adhered (glue, tape, etc.) to the top panel to construct the box. The attachment mechanism (which may be Velcro® straps) will be used to secure the five-sided box to the attic floor, maintaining the proper compression on the gasket and ensuring that the cover remains in place.

The second configuration provides that the sidewalls of the unit will remain in place, usually to act as an insulation dam or baffle (to prevent loose fill insulation from falling into the living space through the attic opening when the attic door is opened, while allowing the loose fill insulation to be installed to a complete depth right up to the edge of the attic access opening). The non-gasketed edge of the sidewalls will be adhered to the building structure (such as joists) or the attic floor either permanently (glue, tape, etc.) or semi-permanently (hook-and-loop, magnetic strip, etc.), while the gasketed edge will face upward to allow the top panel to act as a "lid," resting against the gasket and ensuring a positive air seal. Notably, even when the cover is semi-permanently attached, the assembly is air-tight or otherwise creates a hermetic seal. The attachment mechanism will be used to hold the lid against the top sidewall by using the anchor points that are installed on the lid.

Some exemplary configurations may include a five-sided box lift-off configuration (five panels attached to each other, with the gasketed edge engaging the attic floor, and the attachment mechanism to secure the assembled unit to the floor). Another configuration may provide additional thickness of the construction material to obtain a higher insulation value over part or all of the structure of the device. Another configuration may provide additional insulation added in the form of an additional component, such as the Maximize-R Supplemental Insulation System detailed in U.S. Pat. No. 9,222,265, the entirety of which is incorporated herein by reference, or additional insulation added in the form of some other insulating material (such as spray foam insulation). Another configuration may provide stationary sidewalls (four side panels attached to the attic floor and to each other, with gasketed edge facing up to engage the lid. An attachment mechanism secures the lid to the assembled sidewall system). Another configuration may provide wherein the additional material thickness does not extend below the portion of the product sidewall that will be situated beneath the insulation level on the floor of the attic.

In one aspect, an exemplary embodiment of the present disclosure may provide a multi-mode insulation assembly comprising: a frame formed from insulation material including a first surface and a second surface; a cover formed from insulation material; wherein the frame is installed in one of at least two configurations, wherein when in a first configuration, the first surface engages the cover and the second surface is proximate an attic floor; and wherein when in a second configuration, the first surface engages the floor and the second surface is proximate the cover. The insulation material may have an R-value that is greater than about R-6. This exemplary embodiment of another exemplary embodiment may further provide wherein the cover includes a bottom surface, wherein a portion of the lower surface is vertically above the frame. This exemplary embodiment of another exemplary embodiment may further provide wherein the cover includes a bottom surface, wherein the entirety of the lower surface is vertically above the frame. This exemplary embodiment of another exemplary embodiment may further provide wherein the cover includes a bottom surface aligned along a horizontal plane positioned above the first surface and above the second surface of the frame. This exemplary embodiment of another exemplary embodiment may further provide wherein the cover is free of a depending portion that extends downwardly into the frame. This exemplary embodiment of another exemplary embodiment may further provide wherein the cover is a substantially planar member formed from insulating material having an upwardly facing top surface and downwardly facing bottom surface. This exemplary embodiment of another exemplary embodiment may further provide wherein the cover has a width complementary to the width of the frame and the cover has a length complementary to the length of the frame. This exemplary embodiment of another exemplary embodiment may further provide wherein the cover and the frame are formed from similar insulating material. This exemplary embodiment of another exemplary embodiment may further provide wherein the cover and the frame are formed from polyisocyanurate foam board. This exemplary embodiment of another exemplary embodiment may further provide a gasket attached to the second surface, wherein when the multi-mode insulation assembly is in the first configuration, the gasket sealingly contacts the attic floor to define a substantially hermetic seal, and when in the second configuration, the frame is inverted and the first surface engages the attic floor and the gasket is oriented vertically above and spaced apart from the attic floor to sealingly contact cover. This exemplary embodiment of another exemplary embodiment may further provide an insulation dam defined by the frame attached to the attic floor in the second configuration that prevents attic insulation from falling through the attic floor when the cover is removed from the frame. This exemplary embodiment of another exemplary embodiment may further provide a vertical height of the frame measured from the first surface to the second surface; and a vertical depth of the attic insulation, wherein the vertical height of the frame is greater than the vertical depth of the attic insulation. This exemplary embodiment of another exemplary embodiment may further provide wherein the vertical height of the frame is in a range from 15% to 200% greater than the vertical depth of the attic insulation. This exemplary embodiment of another exemplary embodiment may further provide wherein the vertical height of the frame is about 25% greater than the vertical depth of the attic insulation.

In another aspect, an exemplary embodiment of the present disclosure may provide a method comprising: providing a frame and cover, both formed of insulating material having an R-value greater than about R-6, wherein the cover includes a first surface and a second surface; selecting whether the frame and cover are to be installed in one of a first configuration and a second configuration; wherein, if the first configuration is selected, then orienting a first surface on the frame near an attic floor; and wherein, if the second configuration is selected, then orienting a second surface on the frame near the attic floor so as to allow the first surface to be oriented upwardly enabling the frame to act as a dam to thereby preclude external attic insulation from moving over the frame. This exemplary embodiment of another exemplary embodiment may further provide connecting the second surface of the frame with the attic floor; disconnecting the second surface of the frame from the attic floor; and inverting the frame. This exemplary embodiment of another exemplary embodiment may further provide connecting, subsequent to inverting the frame, the first surface of the frame to the attic floor; and effecting a dam to prevent attic insulation from falling through the attic floor. This exemplary embodiment of another exemplary embodiment may further provide connecting, in a releasable manner, the cover to the frame; and disconnecting the cover from the frame while the frame is connected to the attic floor to dam the attic insulation. This exemplary embodiment of another exemplary embodiment may further provide sealing, hermetically, the frame to the attic floor. This exemplary embodiment of another exemplary embodiment may further provide effecting a vertical height of the frame that defines the same to be in a range from 15% to 200% greater than a depth of the attic insulation.

In yet another aspect, an embodiment of the present disclosure may provide a multimode or multi-configuration insulation assembly, which includes a cover and a frame. The frame has a seal or gasket which may be oriented upwardly in a first configuration or oriented downwardly in a second configuration. In the first configuration, the insulation assembly defines an insulative five-sided box. In the second configuration, the insulation assembly is a four-sided frame with a removable cover, which enables the four-sided frame to remain installed on the attic floor to act as a dam to hold back blown-in attic insulation when the cover is removed to permit ingress and egress to the attic through the opening formed in the attic floor.

BRIEF DESCRIPTION OF THE SEVERAL VIEWS OF THE DRAWINGS

A sample embodiment of the invention, illustrative of the best mode in which Applicant contemplates applying the principles, is set forth in the following description, is shown in the drawings and is particularly and distinctly pointed out and set forth in the appended claims.

Similar numbers refer to similar parts throughout the drawings.

DETAILED DESCRIPTION

Figure 1:
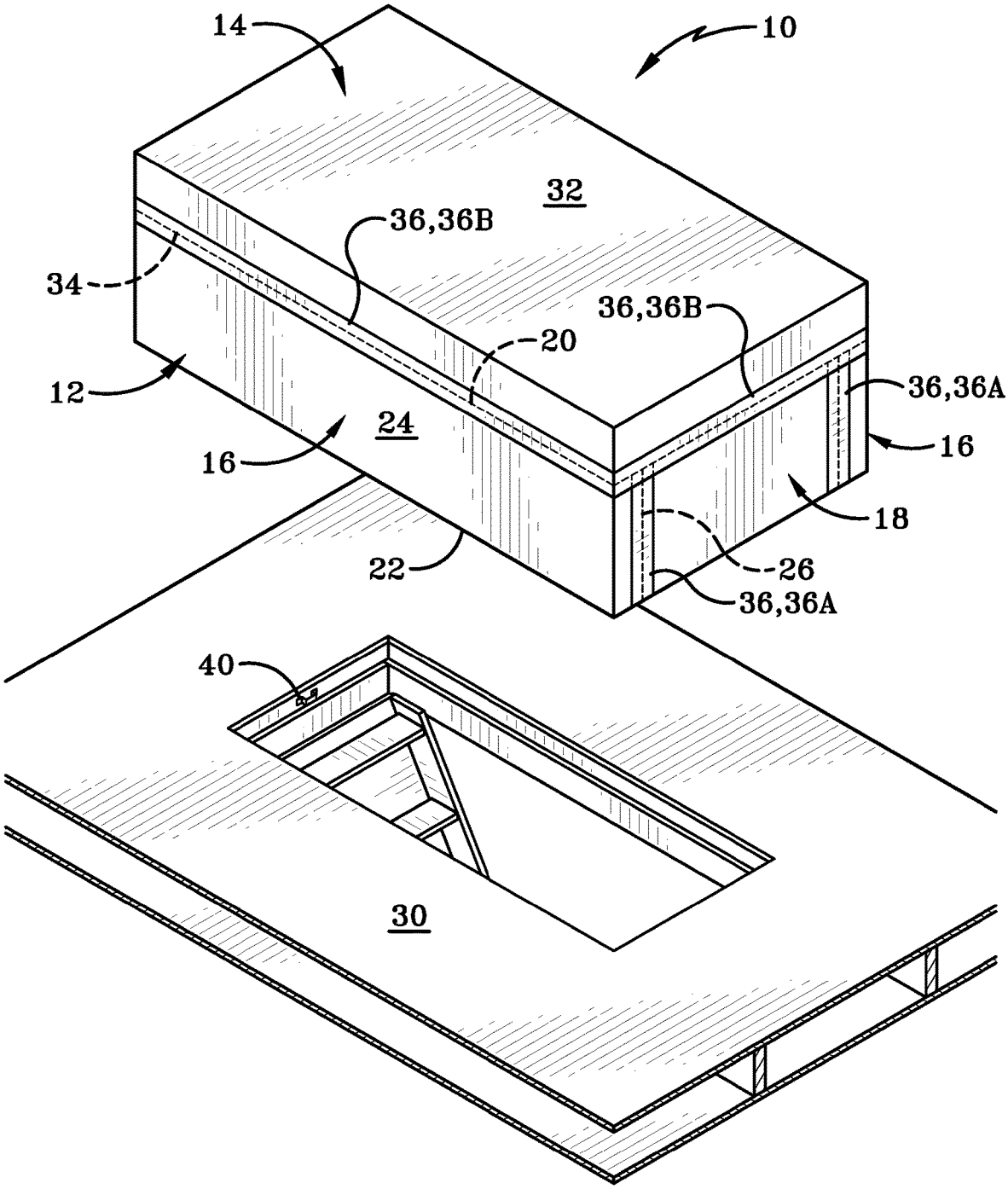
FIG. 1 (FIG. 1) is a perspective view of an insulation assembly in a first configuration in accordance with the present disclosure.
Figure 2:
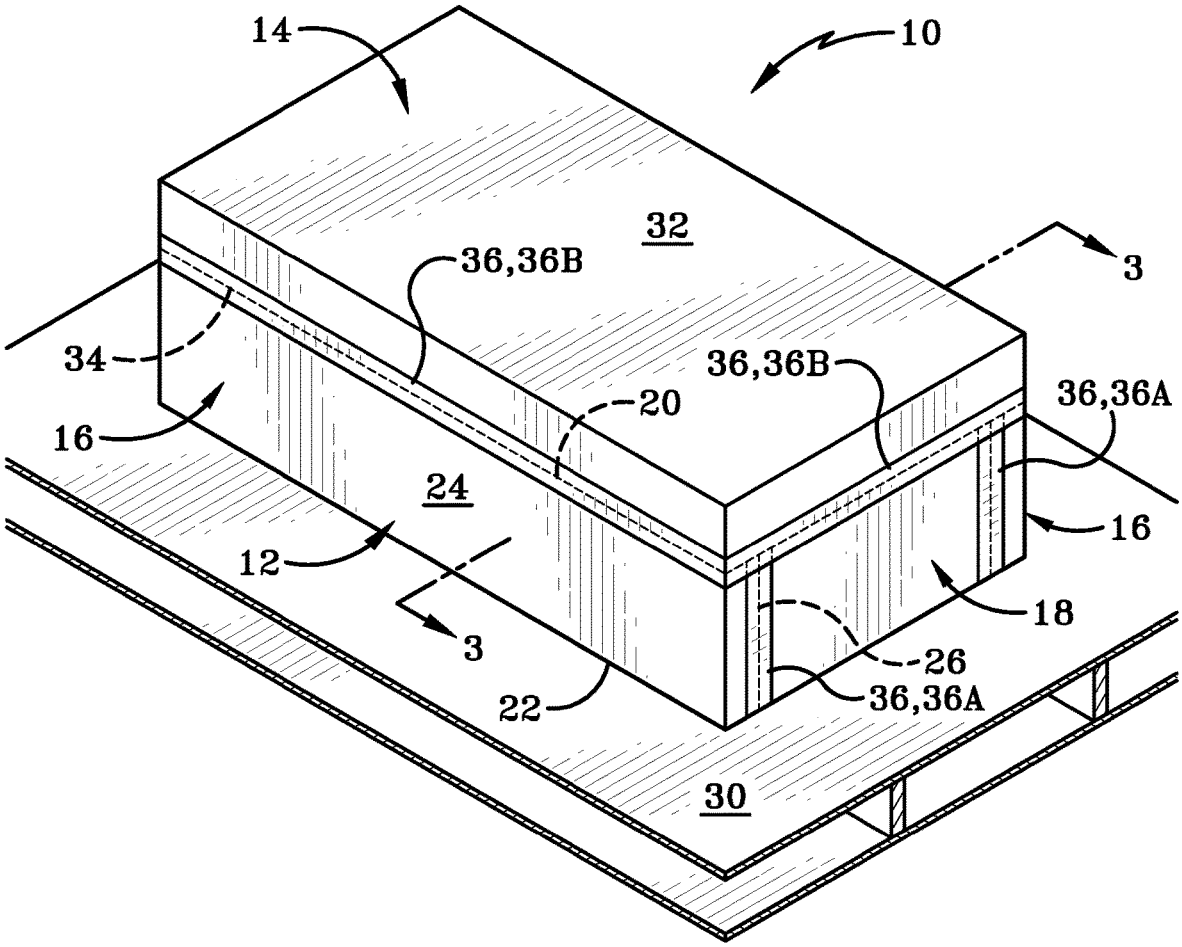
FIG. 2 (FIG. 2) is a perspective view of the insulation assembly in the first configuration installed on an attic floor.
Figure 3:
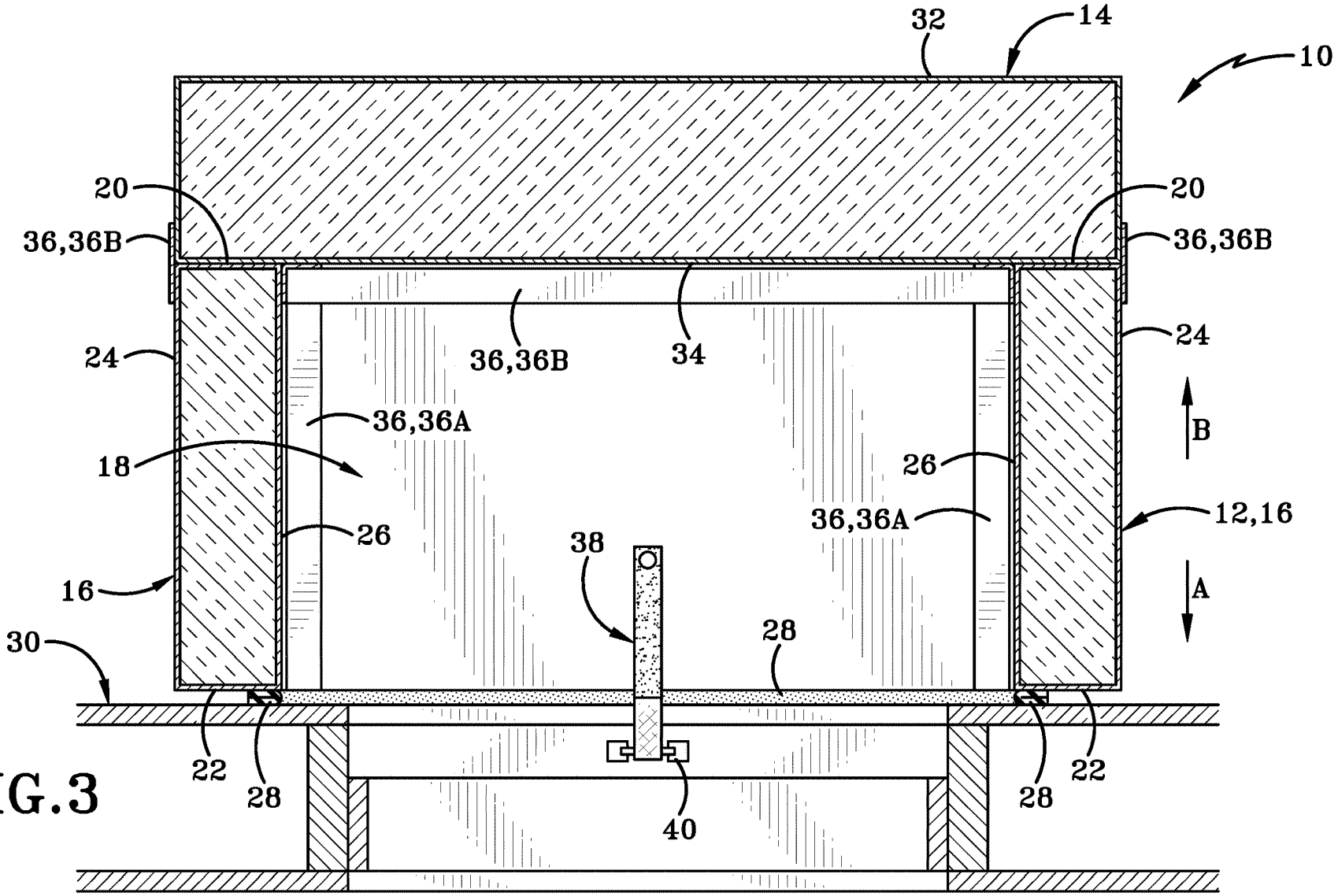
FIG. 3 (FIG. 3) is a cross section of the insulation assembly in the first configuration taken along line 3-3 in FIG. 2.
Figure 4:
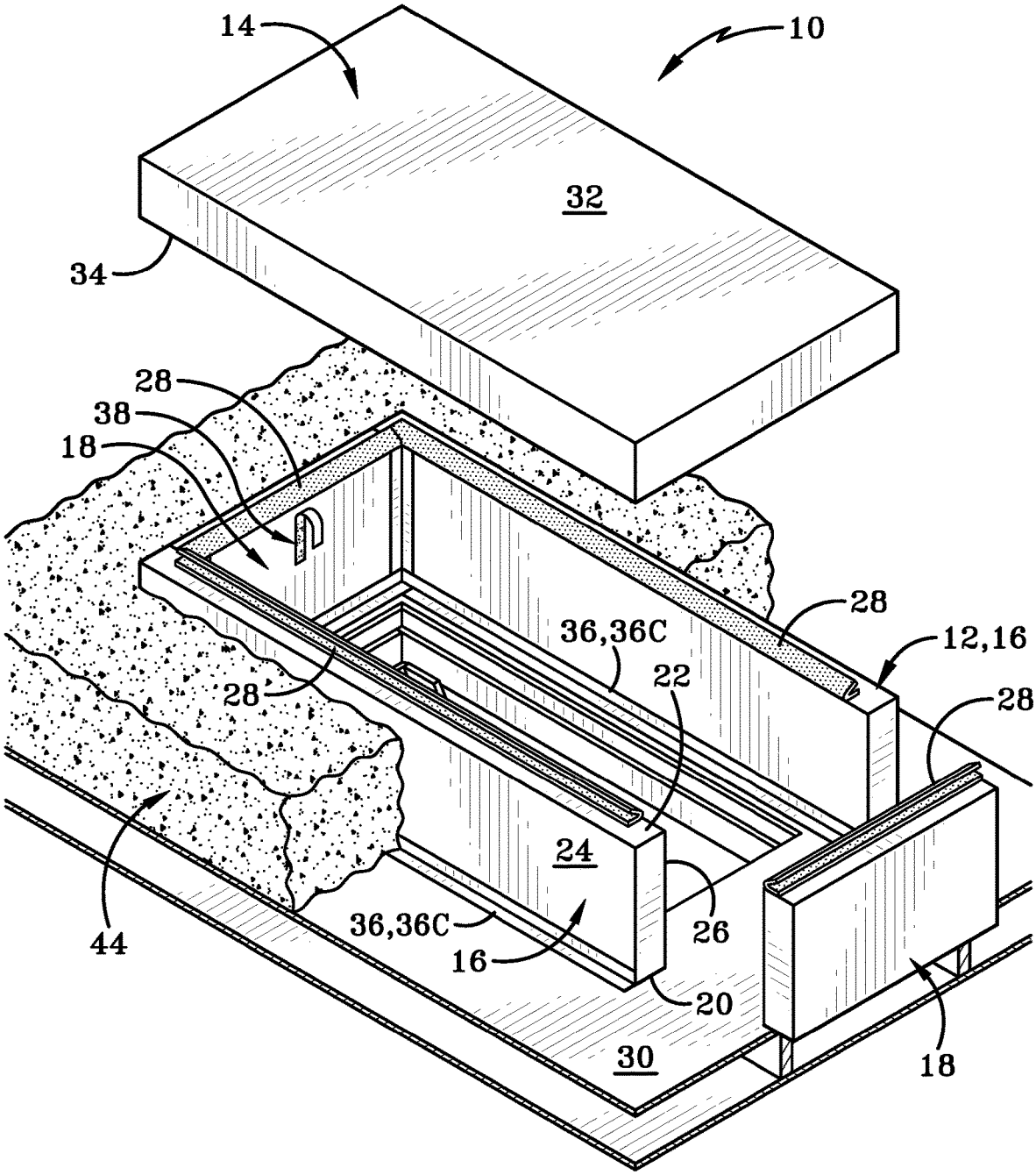
FIG. 4 (FIG. 4) is a partially exploded perspective view of the insulation assembly in a second configuration in accordance with the present disclosure.
Figure 5:
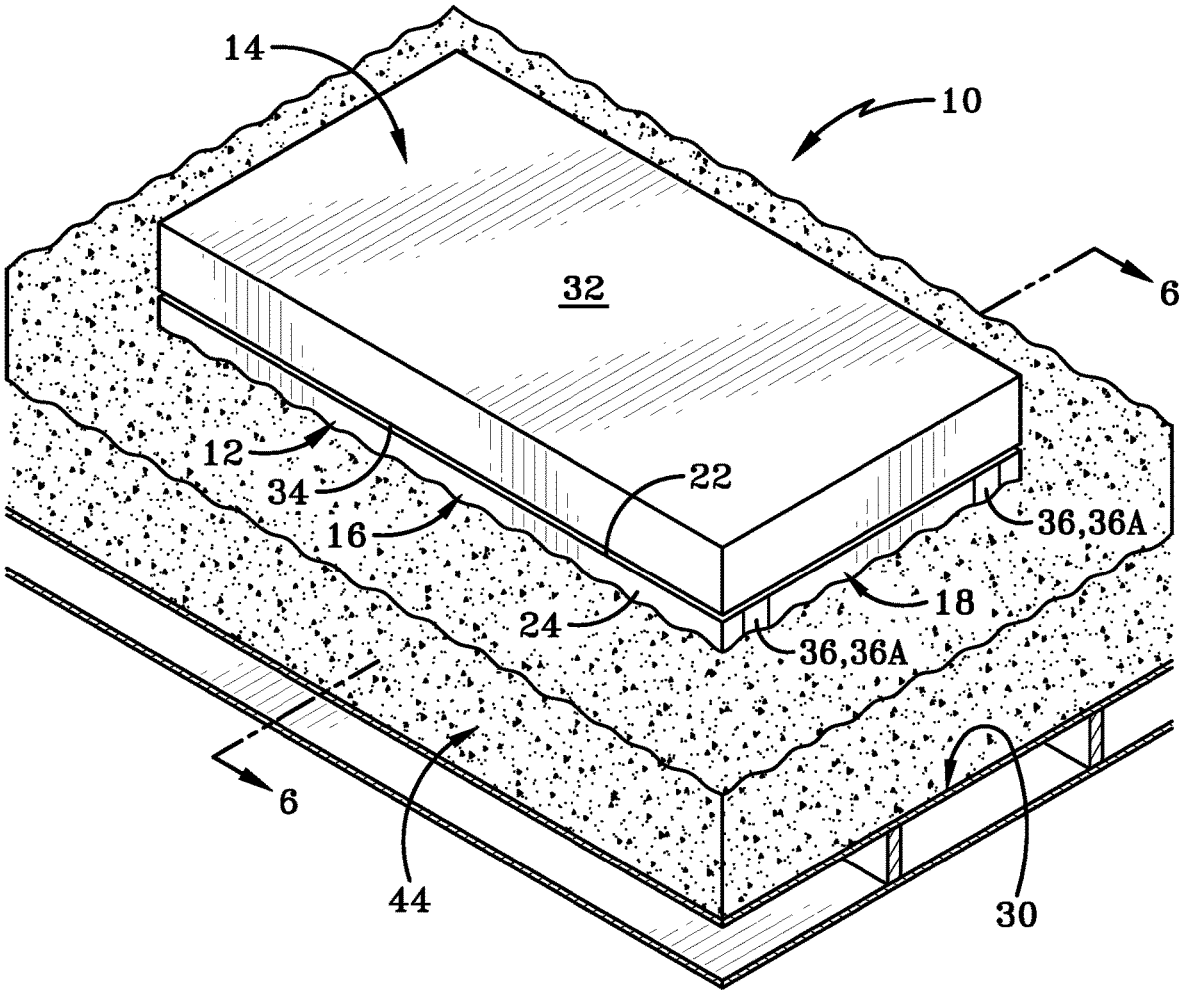
FIG. 5 (FIG. 5) is a perspective view of the insulation assembly in the second configuration.
Figure 6:
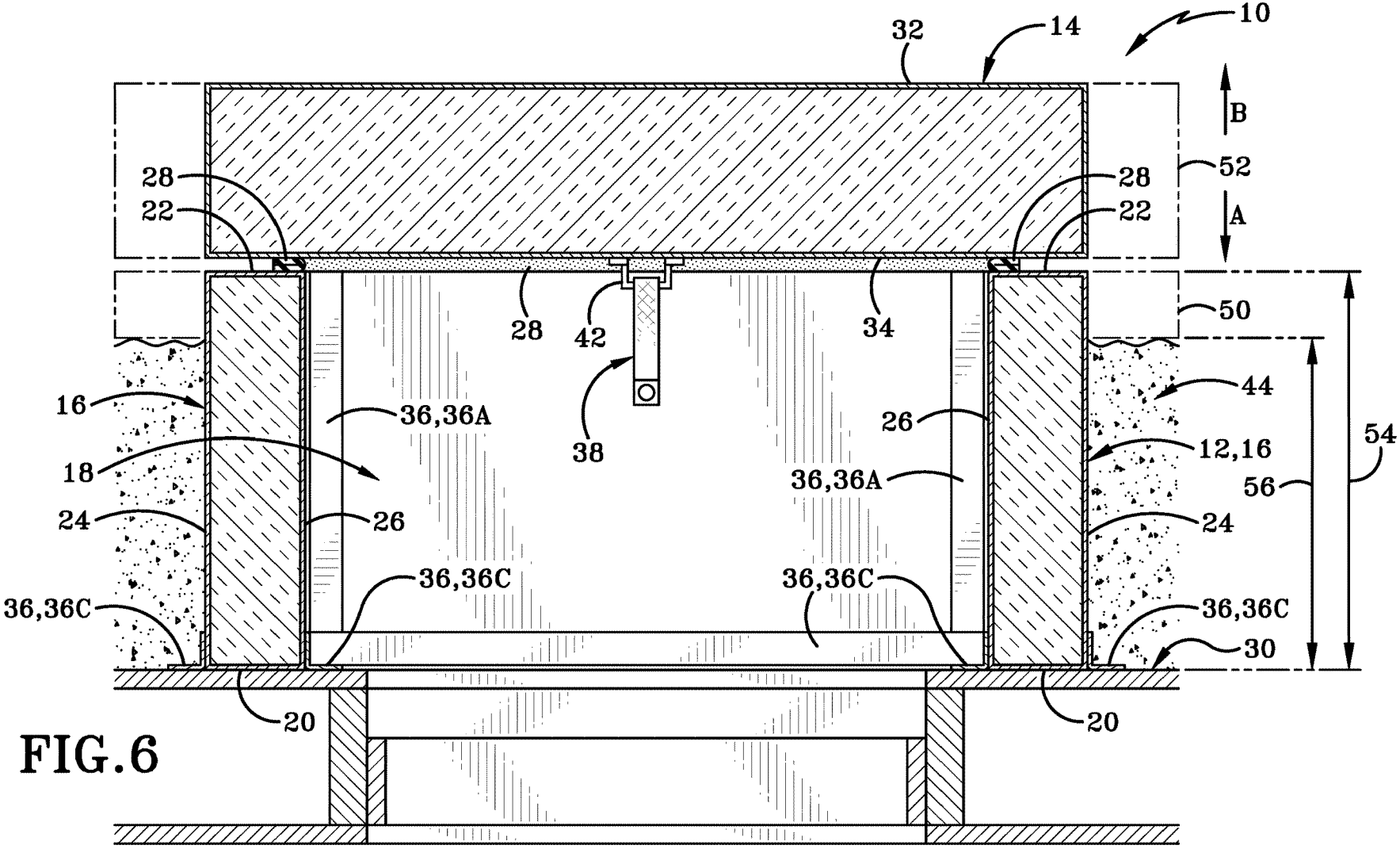
FIG. 6 (FIG. 6) is a cross section of the insulation assembly in the second configuration taken along line 6-6 in FIG. 5.

FIG. 1-FIG. 6 depict a multimode or multi-configuration insulation assembly for an attic opening generally at 10. The insulation assembly 10 may be arranged or configured in a first configuration as shown in FIG. 1-FIG. 3 and may be arranged or configured in a second configuration as shown in FIG. 4-FIG. 6.

Insulation assembly 10 includes an open frame 12 and a cover 14. In one example, the open frame 12 includes longitudinally extending spaced apart parallel sidewalls 16 and transversely extending spaced apart parallel end walls 18. The end walls 18 are abuttingly joined with the sidewalls 16 to form a generally four-sided box-shaped structure defining an interior cavity therein.

Each respective sidewalls 16 and end walls 18 has an outer surface opposite an inner surface. The outer surfaces are oriented to face away from an access opening in an attic, whereas the inner surfaces are oriented to face towards an access opening in the attic. In one example, the thickness of each sidewall 16 and each end wall 18 is determined by the distance between the outer surface and the inner surface. Each respective sidewall 16 and end wall 18 are formed from an insulation material, such as foam board or other insulation that is reinforced with a structural element (i.e., OSB), which provides rigidity and insulation value to the respective wall. In some instances, the insulation value of the end wall 18 or sidewall 16 depends on its thickness. In instances where more insulation (a higher insulative R-value) is required, thicker sidewalls 16 and thicker end walls 18 may be utilized. Alternatively, some dense foam materials have high R-values (such as a rating of R-40 or greater) but still remain relatively thin between the outer surface and the inner surface. Furthermore, some foam boards are provided with a foil layer (not shown) adhered to the rigid foam board itself or other foam boards having an inner and/or outer structural element defining a Structural Insulated Panel (SIP). One exemplary foam board is an insulated wall sheathing. One exemplary material in which the sidewalls 16 and the end walls 18 may be formed is polyisocyanurate; however, other closed cell rigid foam boards are entirely possible, such as expanded polystyrene. Furthermore, other substantially rigid, or at least semi-rigid, boards formed from other materials may be utilized to fabricate sidewalls 16 and end walls 18. For example, OSB or some other rigid (e.g., load bearing, structural, etc.) element may surround on one or both sides of the cover 14, sidewalls 16, or end walls 18. This may protect the insulation foam from being crushed or punctured in some applications.

The open frame 12 includes a first surface 20 opposite a second surface 22 defining a vertical direction therebetween. The first surface 20 and the second surface 22 are defined by the thickness between the inner surface and the outer surface of the respective sidewalls 16 and end walls 18. For example, as indicated in FIG. 3, the outer surface 24 of sidewalls 16 spaced apart parallel from an inner surface 26 facing the access opening, the distance between the inner surface 26 and the outer surface 24 defines the width of first surface 20 and second surface 22.

A seal or gasket 28 is attached to the second surface 22 as indicated in FIG. 3 and FIG. 6. When the insulation assembly 10 is in the first configuration, the gasket 28 sealingly contacts an attic floor 30 to define a substantially hermetic seal. When the insulation assembly 10 is in the second configuration (as seen in FIG. 6), the open frame 12 is inverted such that the first surface 20 engages the attic floor 30 and the gasket 28 is oriented vertically above and spaced apart from the attic floor 30 to sealingly contact cover 14.

Cover 14, in one example, is a substantially planar member having an upwardly facing top surface 32 and downwardly facing bottom surface 34. The top surface 32 faces away from the attic access opening defined in the attic floor 30 and the bottom surface 34 faces towards the access opening defined in the attic floor 30. The cover 14 has a width complementary to the width of open frame 12 measured from the outer surfaces 24 transversely between sidewalls 16. Similarly, cover 14 has a length complementary to the distance between the outer surfaces of the spaced apart and parallel end walls 18. The vertical thickness of cover 14 may be varied depending on the insulation value desired to be achieved. Vertical thickness is measured between the top surface 32 and the bottom surface 34. Furthermore, the orientation in which the cover 14 engages the open frame 12 depends on the orientation thereof as will be described in greater detail below. For example, when the insulation assembly 10 is in the first configuration, as shown in FIG. 3, the cover 14 engages first surface 20 of open frame 12. Conversely, when the insulation assembly 10 is in the second configuration, as indicated in FIG. 6, the cover 14 engages gasket 28 and is positioned closely adjacent the second surface 22. In one example, the cover 14 is formed from a material similar to that which forms sidewalls 16 and end walls 18. Thus, when the sidewalls 16 and the end walls 18 are formed from polyisocyanurate foam board, then the cover 14 may also be formed from polyisocyanurate foam board. However, there may be other instances where the cover 14 is formed from a material different than that of sidewalls 16 and end walls 18.

With continued reference to FIG. 1-FIG. 3, the insulation assembly 10 would ordinarily be provided to an end user as a disassembled set of insulating panels for in situ assembly thereof. The insulation assembly 10 may include adhesive tape 36. This enables the user to arrange the sidewalls 16 in a spaced apart and parallel manner and abuttingly fit the end walls 18 therebetween forming a butt seam. Alternatively, the sidewalls 16 may be arranged to fit between the end walls 18. The butt seams between the sidewalls 16 and the end walls 18 may be joined and sealed together along their inner and/or outer surfaces by covering the seam with a first portion 36A of tape 36. The vertical butt seams covered with first portion 36A of tape 36 for locations (only two shown in FIG. 1) such that the open frame 12 is essentially a four-sided box-like member having an open top and an open bottom. In addition to first portion 36A of tape 36, the sidewalls and end walls may be attached together by applying a bead or film of adhesive to effectuate a hermetic seal between the sidewalls and end walls.

Thereafter, the cover 14 may be placed on top of the first surface 20 of open frame 12 to define a horizontal seam substantially parallel to the attic floor 30 which is hermetically sealed with a second portion 36B of tape 36. Second portion 36B of tape 36 sealingly connects the cover 14 to the open frame 12. While the butt seams have been shown in the present disclosure, it is to be entirely understood that other types of seams may be utilized to adjoin various panels of the insulation assembly 10. Furthermore, while tape 36 is utilized to join and seal the sidewalls 16 to end walls 18, other mechanical, chemical, or non-mechanical and non-chemical fastening mechanisms could be utilized. The second portion of tape 36B may be on the outer surface of frame 12 and cover 14, or on the inner surface of frame 12 and cover 14, or both on the inner surface and the outer surface of the frame 12 and cover 14.

In addition to second portion 36B of tape 36, the cover 14 may be attached to the first surface 20 by applying a bead or film of adhesive between the bottom surface 34 of cover 14 and first surface 20 of open frame 12. This effectuates a hermetic seal between open frame 12 and cover 14 in the first configuration. Alternatively, mechanical fasteners could be utilized, such as bolts, rivets, brads, nails, spikes, or grommets to connect cover 14 with frame 12; however, inasmuch as these mechanical fasteners are not completely air-tight, it would be necessary to use these mechanical fasteners in combination with a seal or gasket or tape 36 or another chemical substance, such as caulk or joint compound or the like, to effectuate a hermetic seal between open frame 12 and cover 14 in the first configuration.

Once the insulation assembly 10 has been assembled in the first configuration, it may be installed on the attic floor 30 as indicated in FIG. 2 and FIG. 3. At least one of the walls (either end wall 18 or sidewall 16) of frame 12 includes a securing mechanism 38. In one example, the securing mechanism 38 is a strap assembly having a traditional loop enclosure securement. In the first configuration, as indicated in FIG. 3, securing mechanism 38 may be looped through an anchor 40 in or on attic floor 30. By looping the securing mechanism 38 through the anchor 40, the user may seal insulation assembly 10 to the attic floor 30 by compressing the gasket 28 by applying more force by pulling the securing mechanism 38 around the anchor 40 and attaching the same to itself. Tightening the securing mechanism 38 is ordinarily accomplished by a user inside the access opening defined in the attic floor 30. Alternatively, the securing mechanism 38 can be an elongated generally elastic cord that connects at opposing ends (either with hooks, or a ball-and-loop, or other connection mechanism), wherein a connection mechanism at one end connects with the floor anchor and the other connection mechanism at the second end connects with an anchor on the inner surface of frame 12. It is to be further understood that securing mechanism 38 could take other forms which effectuate the connection of frame 12 to floor 30 in the first configuration. For example, the securing mechanism could include a handle, strap, or other type of gripping mechanism to enable a user to pull down to create substantially hermetic seal as the securing mechanism is tightened and secured.

As indicated in FIG. 3, the insulation assembly 10 may be lowered to cover the access opening as indicated by arrow A. Once the insulation assembly 10 is lowered and the gasket 28 seals and contacts the attic floor 30, the securing mechanism 38 may be looped around anchor 40 to tightly seal and secure the insulation assembly 10 to attic floor 30. In the event the insulation assembly 10 needs to be removed, the securing mechanism 38 may be released from its engagement with anchor 40 and the insulation assembly 10 may be moved vertically upward to disengage the attic floor 30 surface as indicated by arrow B. In the first configuration, when the insulation assembly 10 is removed from its engagement with the attic floor 30, it moves as one piece or one unit. Stated otherwise, in the first configuration, the sidewalls 16 and the end walls 18 are fixedly connected with cover 14.

FIG. 4-FIG. 6 depict the insulation assembly 10 in its second configuration. FIG. 4 is a partially exploded perspective view of the insulation assembly 10 in its second configuration. The exploded perspective view of FIG. 4 indicates that the end walls 18 form a butt joint between the ends of spaced apart and parallel sidewalls 16. However, the connected sidewalls 16 and end walls 18 are inverted such that the gasket 28 is now facing upwardly and is spaced apart from the attic floor 30. When the open frame 12 is in situ assembled, a user may adhere the first surface 20 to the attic floor 30 via supplied adhesive and may further apply a third portion 36C of tape 36 to hermetically seal the outer surface of the sidewalls 16 and the end walls 18 to the attic floor 30. Additionally, a similar third portion 36C of tape 36 may be attached to the inside surface of the sidewalls 16 and end walls 18 and may be connected to the attic floor 30. Furthermore, the assembly 10 may be constructed in a manner that provides that the entirety or a substantial majority of the exposed foam exterior periphery is covered with tape 36.

The securing mechanism 38 may repeatably and releasably seal cover 14 to the open frame 12 via a second anchor 42 mounted on cover 14. In one example, the second anchor 42 provides a loop that extends downwardly from the bottom surface 34 of cover 14 to enable the securing mechanism 38 to loop therearound and be pulled tight and connected back to itself. Alternatively, the securing mechanism 38 can be an elongated generally elastic cord that connects at opposing ends, wherein a connection mechanism at one end connects with the floor anchor and the other connection mechanism at the second end connects with an anchor on the inner surface of frame 12, or the elastic cord could be looped through a ring to connect both hooks to the anchor near the floor plane. It is to be further understood that securing mechanism 38 could take other forms which effectuate the connection of cover 14 to frame 12 when arranged in the second configuration. For example, the securing mechanism could include a handle, strap, or other type of gripping mechanism to enable a user to pull down to create substantially hermetic seal as the securing mechanism is tightened and secured.

With continued reference to FIG. 4-FIG. 6, the insulation assembly 10 in the second configuration is configured to be used in association with loose fill attic insulation 44 (such as blown-in insulation). As indicated in FIG. 5, when the insulation assembly 10 is fully installed in the second configuration, the blown-in attic insulation 44 extends around at least one or all sides of the insulation assembly 10 and contacts the outer surface 24 of the sidewalls 16 and the end walls 18. In one example, an aspect of the present disclosure provides the ability for the insulation assembly 10 in the second configuration to prevent and preclude blown-in attic insulation 44 from falling through the access opening when the cover 14 is removed from its releasable connection with open frame 12. Stated otherwise, when the cover 14 is removed so as to allow a person to have access to the attic, the connected sidewalls 16 and end walls 18 defining open frame 12 act as a dam or baffle to hold back and prevent any blown-in attic insulation 44 from spilling into (or falling through) the access opening formed in the attic floor 30.

As depicted in FIG. 6, one example of the insulation assembly 10 may include an extension member 50 shown in dashed lines inasmuch as it is optional. Extension member 50 is preferably a strip of insulating foam that is attached near the upper end of the sidewalls 16 and the end walls 18 when the open frame 12 is in the second configuration. Extension member 50 is designed to be positioned above the blown-in insulation 44 so as to provide additional insulation in the upper region of the sidewalls 16 and the end walls 18. When the insulation assembly 10 has the additional extension member 50, the cover 14 may be made wider and longer as indicated at 52 so as to sufficiently cover both the end walls 18 and the sidewalls 16 having extension member 50 thereon.

With continued reference to FIG. 6, the vertical height of the sidewalls 16 and the end walls 18 measured from the first surface 20 to the second surface 22 is represented by distance 54. The vertical depth of the blown-in insulation 44 is represented by vertical distance 56. The height 54 of sidewalls 16 and end walls 18 are greater than the depth 56 of the blown-in insulation 44. In one example, the height 54 of the sidewalls 16 and the end walls 18 is about 25% greater than the depth 56 of the blown-in insulation 44. Thus, if the blown-in insulation 44 has a depth 56 of about four inches, then the height 54 of the sidewalls 16 and the end walls 18 are about five inches. However, other ratios are available. It is contemplated that the height 54 may be at least 15% greater than depth 56 of the blown-in insulation 44. Typically, the height 54 of sidewalls 16 and end walls 18 does not exceed 200% of the depth 56 of blown-in insulation 44. Thus, if height 54 is 15% greater than depth 56, and the depth 56 is about 10 inches, then the height 54 would be about 11.5 inches. However, if the height 54 is 200% greater than the depth 56, and the depth 56 is about 10 inches, then the height 54 of sidewalls 16 and end walls 18 is about 30 inches. Furthermore, in one particular example, the height 54 is about 12 inches. Thus, when the height 54 is about 12 inches, the depth 56 of insulation relative to floor 30 is in a range from about 3 inches to about 10.5 inches.

In one example, cover 14 is a substantially planar member such that both the top surface 32 and the bottom surface 34 are substantially flat. Furthermore, the bottom surface 34 may be flat, having essentially no steps or other recess portions. Alternatively, the bottom surface 34 may be substantially planar across its entire area where no portion of the planar cover 14 is considered a depending portion such that nothing protrudes downwardly into the cavity defined by open frame 12 when the cover 14 is attached in either the first configuration or the second configuration. The bottom surface 34 may lie along and be coplanar with a horizontal plane that is positioned above the first surface 20 and above the second surface 22 of the frame 12. In one embodiment, the bottom surface 34 may be lowermost portion of the cover 14 and is vertically above all of frame 12.

As depicted in FIG. 1-FIG. 6, the insulation assembly 10 for an attic closure is shown as being mounted so as to rest on the attic floor 30 in a surrounding relationship with respect to an access opening formed in the attic floor 30. The access opening in the attic floor 30 is normally closed by a trap door which may, in some instances, be formed as part of a fold down ladder or stairs. In other examples, no pull-down attic stairs or ladder are provided in which case the trap door is mounted within a frame which is provided in the ceiling around the access opening such that the trap door may be inserted upwardly through the access opening and then rest on the frame, thereby closing the access opening to the attic. Conventional trap door and trap door fold down ladder or stair combinations are areas in which thermal losses occur in most building structures as the thermal insulation properties of the trap door is not nearly that of the insulation which is used in the attic space.

In some embodiments, at least one dimension of the assembly 10 may be less than two dimensions of the access opening in the attic floor 30. This may permit the assembly 10 to be constructed at least partially below the attic and then be passed through the opening to be installed on the attic floor. In one example, the height of the assembly (i.e., one of its dimensions) may be less than the length and the width of the access opening. Thus, while the length and the width of the assembly 10 are larger than the access opening, the narrowed height of the assembly 10 may permit it to be maneuvered upwardly through the access opening, if such an installation is required that would have a decreased clearance in the attic that would discourage in situ assembly in the attic.

The indefinite articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

Additionally, the method of performing the present disclosure may occur in a sequence different than those described herein. Accordingly, no sequence of the method should be read as a limitation unless explicitly stated. It is recognizable that performing some of the steps of the method in an different order could achieve a similar result.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

The invention claimed is:

1. A multi-mode insulation assembly comprising:

a frame formed from insulation material having four sidewalls with each sidewall including an inner surface and an outer surface, and the frame including a first surface and a second surface;

a securing mechanism on at least one of the four sidewalls;

a cover formed from insulation material;

wherein the multi-mode insulation assembly is moveable between two configurations, including:

(i) an installed first configuration in which the first surface of the frame is fixedly connected to the cover with the securing mechanism, and the second surface of the frame is proximate an attic floor, thereby defining an inverted five-sided box that is removably placed on the attic floor; and (ii) an installed second configuration in which the first surface is fixedly connected to the attic floor with the securing mechanism, and the second surface is proximate the cover thereby defining a four-sided frame fixedly connected to the attic floor with the cover removably connected to the four-sided frame and the four sidewalls forming an insulation dam to prevent loose-fill insulation in an attic from falling through an access opening in the attic floor.

2. The multi-mode insulation assembly of claim 1, wherein the cover includes a bottom surface, wherein the entirety of the bottom surface is vertically above the frame in both the installed first configuration and the installed second configuration.

3. The multi-mode insulation assembly of claim 1, wherein the cover includes a bottom surface aligned along a horizontal plane positioned above the first surface and above the second surface of the frame in both the installed first configuration and the installed second configuration.

4. The multi-mode insulation assembly of claim 1, wherein the cover is free of a depending portion that extends downwardly into the frame.

5. The multi-mode insulation assembly of claim 1, wherein the cover is a substantially planar member formed from insulating material having an upwardly facing top surface and downwardly facing bottom surface.

6. The multi-mode insulation assembly of claim 5, wherein the cover has a width complementary to the width of the frame and the cover has a length complementary to the length of the frame.

7. The multi-mode insulation assembly of claim 6, wherein the cover and the frame are formed from similar insulation material.

8. The multi-mode insulation assembly of claim 7, wherein the cover and the frame are formed from polyisocyanurate foam board.

9. The multi-mode insulation assembly of claim 1, further comprising:

a gasket attached to the second surface, wherein when the multi-mode insulation assembly is in the installed first configuration, the gasket sealingly contacts the attic floor to define a substantially hermetic seal for the five-sided box, and when the multi-mode insulation assembly is in the installed second configuration, the frame is inverted and the first surface engages the attic floor and the gasket is oriented vertically above and spaced apart from the attic floor to sealingly contact the cover for the four-sided frame.

10. The multi-mode insulation assembly of claim 1, further comprising:

a vertical height of the frame measured from the first surface to the second surface; and a vertical depth of the attic insulation, wherein the vertical height of the frame is greater than the vertical depth of the attic insulation.

11. The multi-mode insulation assembly of claim 10, wherein the vertical height of the frame is in a range from 15% to 200% greater than the vertical depth of the attic insulation.

12. The multi-mode insulation assembly of claim 11, wherein the vertical height of the frame is about 25% greater than the vertical depth of the attic insulation.

13. A method comprising:

providing a frame and cover, both formed of insulating material, wherein the frame includes a first surface and a second surface and the cover includes a top surface and a bottom surface, and a securing mechanism on at least one of four sidewalls of the frame;

selecting whether the frame and cover are to be installed in one of a first configuration and a second configuration;

wherein if the first configuration is selected, then orienting the first surface on the frame near an attic floor to define a five-sided box that covers an access opening in the attic floor, and in which the second surface of the frame is fixedly connected to the cover via the securing mechanism; and wherein if the second configuration is selected, then orienting a second surface on the frame near the attic floor in which the second surface is fixedly connected to the attic floor via the securing mechanism so as to allow the first surface to be oriented upwardly to define a four-sided frame secured to the attic floor with the cover removably connected to the frame and the four sidewalls forming an insulation dam, and damming external attic insulation to preclude the external attic insulation from moving through the attic access opening.

14. The method of claim 13, further comprising:

connecting the second surface of the frame with the attic floor;

disconnecting the second surface of the frame from the attic floor; and inverting the frame.

15. The method of claim 14, further comprising:

connecting, subsequent to inverting the frame, the first surface of the frame to the attic floor; and effecting a dam to prevent attic insulation from falling through the attic floor.

16. The method of claim 15, further comprising:

connecting, in a releasable manner, the cover to the frame; and disconnecting the cover from the frame while the frame is connected to the attic floor to dam the attic insulation.

17. The method of claim 16, further comprising:

sealing, hermetically, the frame to the attic floor.

18. The method of claim 16, further comprising:

effecting a vertical height of the frame to be in a range from 15% to 200% greater than a depth of the attic insulation.

* * * * *